US008154217B2

(12) United States Patent
Bergmann et al.

(10) Patent No.: US 8,154,217 B2
(45) Date of Patent: Apr. 10, 2012

(54) DRIVER CIRCUIT, METHOD FOR OPERATING AND USE OF A CURRENT MIRROR OF A DRIVER CIRCUIT

(75) Inventors: Guenther Bergmann, Blaustein (DE); Peter Kolb, Illertissen (DE); Holger Vogelmann, Schwendi (DE); Michael Offenwanger, Burgau (DE)

(73) Assignee: Atmel Corporation, San Jose, CA (US)

( * ) Notice: Subject to any disclaimer, the term of this patent is extended or adjusted under 35 U.S.C. 154(b) by 489 days.

(21) Appl. No.: 12/403,879

(22) Filed: Mar. 13, 2009

(65) Prior Publication Data

US 2009/0230879 A1 Sep. 17, 2009

Related U.S. Application Data

(60) Provisional application No. 61/036,446, filed on Mar. 13, 2008.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/291; 315/301; 315/304; 315/307

(58) Field of Classification Search ..... None
See application file for complete search history.

(56) References Cited

U.S. PATENT DOCUMENTS

| | | | | |
|---|---|---|---|---|
| 4,740,743 | A | 4/1988 | Reisinger et al. | |
| 5,701,060 | A | 12/1997 | Buhler et al. | |
| 5,796,767 | A * | 8/1998 | Aizawa | 372/38.02 |
| 7,145,929 | B2 | 12/2006 | Bergmann et al. | |
| 7,362,142 | B2 * | 4/2008 | Ozasa et al. | 327/66 |
| 7,466,202 | B2 * | 12/2008 | Karthaus et al. | 330/288 |
| 2002/0196212 | A1 | 12/2002 | Nishitoba et al. | |
| 2005/0127988 | A1 | 6/2005 | Ozasa et al. | |

(Continued)

FOREIGN PATENT DOCUMENTS

DE 10 2005 022 612 A1 11/2006

(Continued)

OTHER PUBLICATIONS

Office Action for German Patent Application No. 10 2008 014 425.8, Jul. 5, 2011.

*Primary Examiner* — Anh Tran
(74) *Attorney, Agent, or Firm* — Baker Botts L.L.P.

(57) ABSTRACT

A driver circuit, operating method, and use of a current mirror of a driver circuit is provided that includes at least one output transistor, a reference network with at least one reference transistor, a switching device, which is connected to the control input of the output transistor and to the control input of the reference transistor to form a switchable current mirror, a current source for providing a reference current for a reference current path, whereby the current source and the reference transistor are arranged in the reference current path, a load terminal, whereby the load terminal and the output transistor are arranged in a load current path, and at least one damping network, which is connected to or connectable to the reference current path. Wherein a connection of components of the at least one damping network and a connection of components of the reference network are substantially the same.

20 Claims, 5 Drawing Sheets

U.S. PATENT DOCUMENTS

| | | | |
|---|---|---|---|
| 2005/0285666 | A1 | 12/2005 | Garlapati et al. |
| 2006/0255838 | A1 | 11/2006 | Bergmann |
| 2007/0164813 | A1 | 7/2007 | Sakaguchi |
| 2007/0253313 | A1 | 11/2007 | Mizuno |
| 2007/0285171 | A1 | 12/2007 | Karthaus et al. |

FOREIGN PATENT DOCUMENTS

| | | | |
|---|---|---|---|
| EP | 0 810 700 | A2 | 12/1997 |
| EP | 1 478 063 | A2 | 11/2004 |
| JP | 2001-36187 | A | 2/2001 |
| JP | 2003-338744 | A | 11/2003 |

* cited by examiner

DRIVER CIRCUIT, METHOD FOR OPERATING AND USE OF A CURRENT MIRROR OF A DRIVER CIRCUIT

This nonprovisional application claims priority to German Patent Application No. 10 2008 014 425.8, which was filed in Germany on Mar. 14, 2008, and to U.S. Provisional Application No. 61/036,446, which was filed on Mar. 13, 2008, and which are both herein incorporated by reference.

BACKGROUND OF THE INVENTION

1. Field of the Invention

The invention relates to a driver circuit, to a method for operating a driver circuit, and to a use of a current mirror.

2. Description of the Background Art

Japanese Patent Document No. JP 2001 036187 A discloses a driver circuit for a laser diode. The load current to be driven is generated by a differential pair of transistors and subsequent amplification with a current mirror.

European Patent No. EP 1 478 063 D1, which corresponds to U.S. Pat. No. 7,145,929, and which discloses a driver circuit for operating an electronic component. The driver circuit drives a current which is switched in a controlled manner between at least two discrete current strengths. The driver circuit has a current mirror circuit with a reference transistor and with another transistor connected to the output. The driver circuit in this case is formed to realize a frequency-dependent mirror factor. As a result, the effective collector base capacitance of the driver circuit is reduced. To this end, the additional transistor connected to the output is connected in series with a resistor and an inductor.

German Patent Application No. DE 10 2005 022 612 A1, which corresponds to U.S. Publication No. 20060255838, and which discloses a driver circuit for electronic components. In this case, an amplifier is provided which generates a control signal from a reference signal. Furthermore, a driver current mirror and a control signal switch arranged between the amplifier and the driver current mirror are provided. The control signal switch connects the amplifier optionally with the driver current mirror or separates these. The amplifier is connected to a compensation circuit, which together with the amplifier provides a regulated current source.

U.S. Patent Application No. 20070253313 A1 discloses a laser driver and a method for driving the laser, as well as a recording and reading device. European Patent No. EP 0 810 700 A2, which corresponds to U.S. Pat. No. 5,701,060, also discloses a driver circuit for a laser diode. Damping circuits connected in series reduce ringing on the laser diode current, the ringing being caused by three different resonances which are coupled together.

SUMMARY OF THE INVENTION

It is therefore an object of the invention to improve a driver circuit as much as possible.

Accordingly, a driver circuit with at least one output transistor is provided. Furthermore, the driver circuit can have a reference network with at least one reference transistor. The output transistor and the reference transistor in the connected state form a current mirror. A transformation ratio of the current mirror, therefore a ratio of a load current through the output transistor to a reference current through the reference transistor, is greater than 1, so that the load current exceeds the reference current. It is also preferably provided here that both the reference transistor and the output transistor are field-effect transistors. The reference network has several components connected to form a network. One of these components is the reference transistor. Particularly in its function as part of the current mirror, the reference transistor advantageously has a reference voltage at its control input. This reference voltage can be adjusted by means of the reference current; in this case, a load current to be driven by the output transistor depends on this reference voltage.

Furthermore, the driver circuit can have a switching device, which is connected to a control input of the output transistor and to a control input of the reference transistor to form a switchable current mirror. Preferably, the switching device is connected here to the reference transistor and to the control input of the output transistor. The control input of the output transistor is preferably a gate of the output transistor as a field-effect transistor. The control input of the reference transistor is also preferably a gate of the reference transistor as a field-effect transistor. The switching device in a turned-on state connects conductively the control inputs of the output transistor and the reference transistor with one another. The output transistor and the reference transistor in this turned-on state act as a current mirror with a current mirror transformation ratio established by transistor geometry. In the turned-off state, the switching device separates the control inputs of the output transistor and of the reference transistor. The load current through the output transistor is turned off by this means. If in an exemplary embodiment the output transistor is formed as a MOS field-effect transistor, it can be advantageous to discharge in addition the control input (gate electrode) of the output transistor, for example, via a resistor.

The driver circuit furthermore can have a current source for providing a reference current for a reference current path. The current source and the reference transistor of the reference network are arranged in the reference current path. The current source is understood here to be a source or drain depending on the flow direction of the electrons or holes. Preferably, the current source is formed to be adjustable, whereby the reference current is set by means of an analog or digital setting signal. Advantageously, the current source in this case is formed in such a way that the reference current is provided with the lowest possible sensitivity to the temperature of the driver circuit and supply voltage variations. For example, the current source is coupled switchably to an external or driver circuit-internal current source, for example, via another, for example, switchable, current mirror.

In the steady state, the predominant part of the reference current flows through the reference current path and thereby through the reference transistor. In the dynamic case, when the load current through the output transistor changes significantly, displacement currents in particular can flow to or away from connection nodes in the reference current path. The reference current path is defined by the arranged components and connections through which the predominant portion of the reference current flows. The reference current path can also have parasitic components, for example, line inductors, in addition to the cited components such as the reference transistor and the current source.

Furthermore, the driver circuit can have a load terminal. The load terminal and the output transistor are arranged in a load current path. The load terminal is, for example, a pin or a pad of an integrated circuit into which the driver circuit is integrated. It is therefore possible to connect a load, for example, a laser diode or light-emitting diode, with the pin or pad. The load current path is defined by the components and connections through which the predominant part of the load current flows.

At least one damping network of the driver circuit is connected to or connectable to the reference current path. For the connection, the damping network is preferably connected to at least one node in the reference path. Alternatively, the damping network is connected to a switching element, whereby the switching element is connected in turn to at least one node of the reference path. The damping network is not the same as the reference network, but advantageously it is formed similarly. The damping network dampens a tendency for oscillation or overshooting of the driver circuit itself. Preferably, one or more damping networks are provided for different dampings or for different load current amplitudes or for different edge steepnesses of the load current. Preferably, the damping network is connected to at least one supply voltage terminal of the driver circuit.

The damping network can be connected with precisely one node of the reference current path. Especially preferably, the current source is also connected to the node to provide the reference current. The damping network is connected to the reference current path by providing a fixed conducting connection, particularly a metallic trace, between the damping network and reference current path. Alternatively, the damping network can be connected to the reference current path by providing a switching element such as, for example, a field-effect transistor or bipolar transistor, a settable resistor, or a safeguard between the damping network and the reference current path.

It is another object of the invention to provide a method for operating a driver circuit.

Accordingly, a method for operating a driver circuit is provided. Preferably, the driver circuit is formed according to the aforementioned embodiments. In the method, a damping is set for a predefined signal shape of a load current to be driven. The predefined signal shape in this case preferably comprises the specification of the signal amplitude and/or the specification of an edge steepness of the signal and/or a degree of overshoot of the signal and/or a signal delay time. The load current to be driven is provided in this case at an output of the driver circuit. The damping thereby reduces a tendency for oscillation or overshooting of an entire circuit comprising a driver circuit and load.

The damping can be adjusted by connecting a reference current path to at least one damping network for the specific signal shape of the load current to be driven. The reference current path in this case is part of a switchable current mirror. The connection in this case occurs by means of a least one connecting element, which is connected to the reference current path and the damping network. For the connection, the at least one connecting element can be switched, for example, between two switching states. It is also possible for connecting to set the at least one connecting element by means of a control signal to an impedance, particularly a desired resistance value. The at least one connecting element is preferably formed as an adjustable resistor, particularly as a field-effect transistor. Preferably, the current mirror is switchable by means of a switching device, whereby the switching signal for the switching device is formed depending on the connection between the reference current path and damping network.

A further object of the invention is for providing a use of the current mirror.

Accordingly, a use of a switchable current mirror and at least one damping network is provided for setting a signal shape of a load current by a load current path of the switchable current mirror. The current mirror in this case is formed switchable by means of a switching transistor. The switchable current mirror is part of a reference current path and a load current path. Furthermore, the reference current path has a current source. The load current path, however, is connected to the load. The switching transistor switches a connection between the reference current path and the load current path. The switching transistor in a turned-on state connects two transistors of the current mirror conductively to one another, so that the current mirror in the turned-on state functions as such with a transformation ratio. In the turned-off state, the switching transistor again separates the two transistors of the current mirror, so that the load current is turned off.

The damping network is connected to or connectable to the reference current path and the current source in order to set the signal shape of the load current. Preferably, the damping network can be connected to the reference current path by means of an active component, such as, for example, a controllable resistor or a semiconductor switch.

The refinements described hereinafter refer to the driver circuit and to the method, as well as to the use.

It is also provided that all transistors of the driver circuit are field-effect transistors, particularly MOS field-effect transistors. Advantageously, all transistors are part of a CMOS technology. Preferably, all components of the driver circuit can be integrated monolithically on a semiconductor chip.

In an embodiment, the at least one damping network and the reference network each have components, whereby connections of the components in the damping network are the same as the connections of the components in the reference network. Advantageously, the reference network and the damping network have components of the same component type. Advantageously, the damping network and the reference network have a corresponding connection of their components. To this end, the damping network and the reference network have the same number of components and connections between the components. It is preferably provided in this case that the current densities are similar in corresponding components of the reference network and the damping network. Preferably, the components of the reference network and the damping network are paired (matching). Preferably, in this case, the damping network has a paired transistor for each transistor of the reference network.

According to another embodiment, the driver circuit has a control element. In order to set damping by the at least one damping network the control element is connected to the damping network and the reference network. Preferably, the control element is connected to the damping network and to the reference network. The control element in this case has a digital or analog control input. The controlling element is, for example, a switch or a controllable resistor.

According to an embodiment, an least one additional current source can be connected to the at least one damping network. Preferably, the current provided by the additional current source is adapted to the current densities in the damping network.

In an embodiment, the reference network has a first transistor which is connected as a source follower or emitter follower and whose control input is connected to the reference current path and whose source or emitter is connected to the control input of the reference transistor. Advantageously, the first transistor is of the same type as the reference transistor. A resistance device is preferably connected to the emitter or the source of the first transistor, the resistance device being connected in addition to a supply voltage. According to an advantageous embodiment, the control input of the first transistor of the reference network is connected to the current source.

According to an embodiment, it is provided that the switching device has a first switching transistor. The first switching transistor is connected to the control input of the output transistor and to the control input of the reference transistor.

Preferably, the first switching transistor has a switching path, which can connect the control input of the reference transistor to the control input of the output transistor. Preferably, the first switching transistor is a field-effect transistor; here, its source or drain is connected to the control input of the output transistor and its source or drain is connected to the control input of the reference transistor.

The switching device can have a second switching transistor. The second switching transistor is connected to the control input of the output transistor and to a supply voltage. The second switching transistor is preferably wired in such a way that its switching path can connect the control input of the output transistor to a supply voltage. Preferably, the second transistor is also formed as a field-effect transistor, whereby its source or drain is connected to the control input of the output transistor and whereby its source or drain is connected to the supply voltage directly or indirectly via another component. The additional component is an inductor, for example.

In an embodiment, it is provided that the driver circuit can have a signal-shaping device. The signal-shaping device is formed to shape a first control signal and/or a second control signal for the first switching transistor or the second switching transistor, respectively. The shaped first control signal or the shaped second control signal causes a correlative change in the signal shape of the load current. Thus, for example, a flatter edge steepness of the control signal of the first control signal for the first switching transistor results in a correspondingly smaller edge steepness during the load current switching process.

The signal-shaping device can be connected for this purpose to the control input of the first switching transistor and/or to the control input of the second switching transistor. Advantageously, the signal-shaping device is formed to set the edge steepness. The signal-shaping device makes it possible to set the shape of the first control signal and/or the second control signal and/or the phase shift or delay between the first control signal and the second control signal.

According to another embodiment, it is provided that the reference network has a first resistance element. The resistance element is arranged in the reference current path and connected to the reference transistor and the control input of the first transistor. According to another refinement variant, which is possible by itself or in combination with the aforementioned refinement variant, a second resistance element is provided in the reference network. The second resistance element arranged in the reference current path is connected to the reference transistor and a supply voltage.

The resistance of the second resistance element can be designed in such a way that it compensates for a voltage drop caused across lines in the load current path by a corresponding voltage drop across the second resistance element in the reference current path.

An embodiment provides that the switching device can have a capacitive element. This type of capacitive element is, for example, a MIM capacitor, a MOS diode, or a transistor wired as a MOS diode. The capacitive element is connected to the control input of the output transistor and in order to compensate for the displacement current is supplied by the first switching transistor with a signal inverted relative to the control signal of the first switching transistor. In the ideal case, the displacement current through the first switching transistor and the displacement current through the capacitive element are cancelled.

According to another embodiment, the current mirror can be formed as a cascode current mirror. Another transistor, which is connected in series to the reference transistor to form a cascode circuit, is arranged in the reference current path. In the load current path, another output transistor is arranged, which is connected in series to the output transistor to form an output cascode circuit. The control inputs of the additional transistors, therefore of the additional output transistor and of the additional reference transistor, are preferably connected to a voltage source in such a way that the additional transistors are operated in a gate circuit or base circuit.

The previously described refinement variants are especially advantageous both individually and in combination. In this regard, all refinement variants can be combined with one another. Some possible combinations are explained in the description of the exemplary embodiments shown in the figures. These possible combinations of the refinement variants, depicted there, are not definitive, however.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
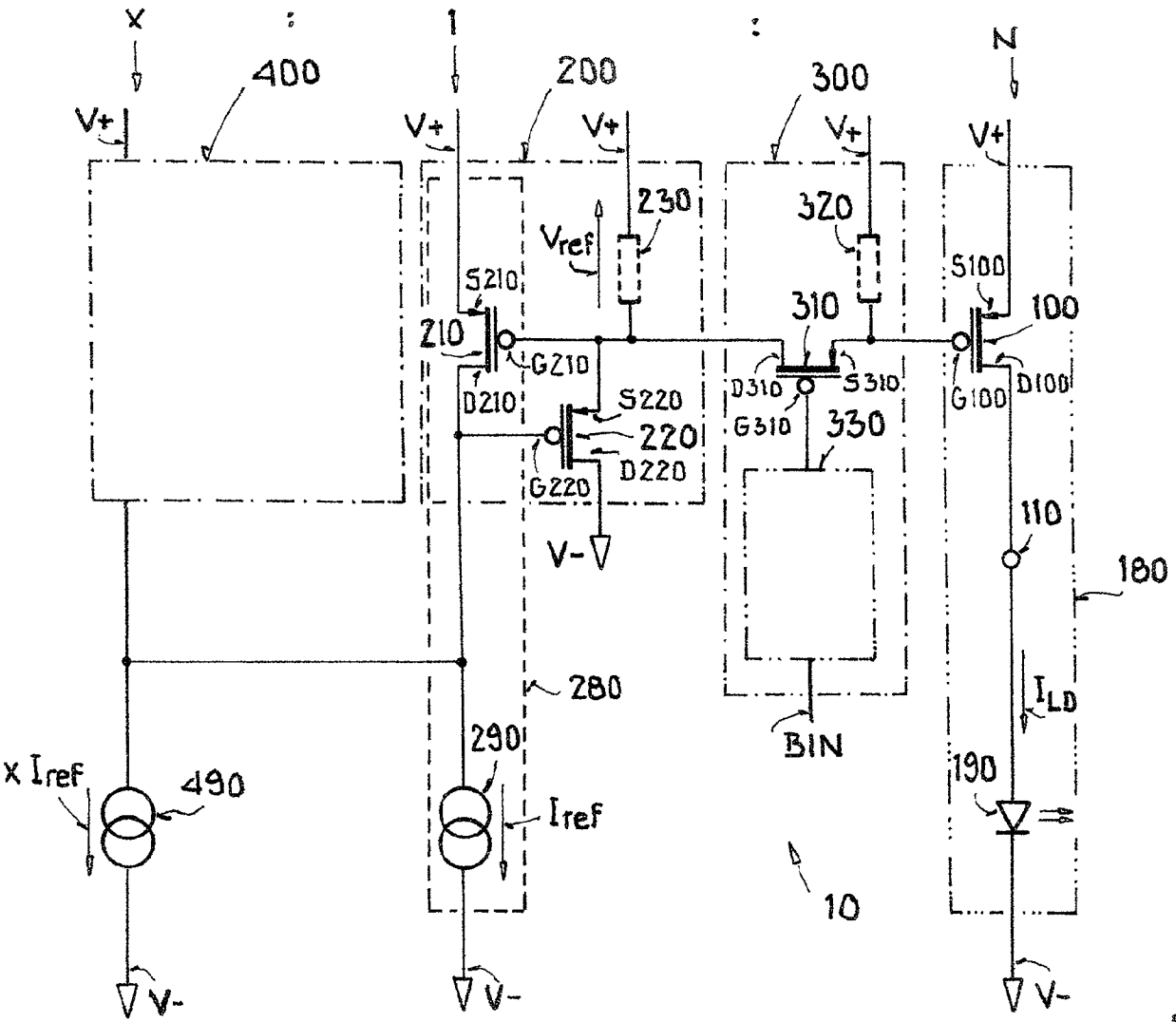
FIG. 1 shows a first exemplary embodiment of a driver circuit.

FIG. 1 shows a driver circuit 10. This type of output stage 10 together with a pulse generator is preferably used to control a laser diode 190. Laser diodes with different wavelengths of the emitted optical power are needed to read/write information from/on optical storage media (CD—Compact Disc/DVD—Digital Versatile Disc). The desirable high storage densities of the media in conjunction with a high read and write speed require the generation of precise current pulses for the laser diodes. Here, the precision relates to time accuracy and to the curve shape of the pulses, such as, for example, overshoot, ringing, amplitude accuracy, etc. The shape of the signal of the current pulse for laser diode 190 thereby depends critically on the structure of driver circuit 10.

The rise and fall times and the transient times of the pulses for a specific pulse signal amplitude can be optimized by means of a current mirror in CMOS technology. The rise and fall times and the transient times by means of a current mirror in CMOS technology are greatly current-dependent, however. Thus, optimization of a current mirror in CMOS technology is possible by means of transistor geometries and the transmission factor N for a specific current strength, for example, 200 mA. However, a satisfactory solution, which meets the requirements for use of different laser currents for the needs of different drives such as CD, DVD, Blue-Ray, or HD-DVD, can be found only on the basis of driver circuit 10 according to FIG. 1 with the currently available CMOS technology. Current pulses with several 100 mA strengths and rise and fall times under a nanosecond are necessary for some of these applications.

Driver circuit 10 according to the exemplary embodiment of FIG. 1 has the advantage of very low rise and fall times of the laser current $I_{LD}$. Furthermore, the turn-on and turn-off time of the current pulse can be set separately for different signal amplitudes of the laser current $I_{LD}$. In the exemplary embodiment of FIG. 1, a high amplification of the current mirror can be set without a major effect on the rise and fall rate of the output current. In this way, a high ratio between the output current and reference current can be achieved, so that a greater efficiency is achieved as a surprising effect.

FIG. 1 has a current mirror with output transistor 100 and a reference transistor 210 as mirror transistors. 1:N in this case is the geometric scaling factor between the two mirror transistors 100 and 210. For example, the geometric scaling factor is N=10. Output transistor 100 is connected to reference transistor 210 via switching device 300. In the turned-on state, switching device 300 connects gate G100 of output transistor 100 with gate G210 of reference transistor 210. In contrast, switching device 300 separates the two gates G100 and G210 in the turned-off state.

The turned-on state and turned-off state are thereby controlled as a function of the digital data at the digital data input BIN. The load current $I_{LD}$ which flows through laser diode 190 thereby depends on a reference current Iref as a proportionality. In the exemplary embodiment of FIG. 1, output transistor 100 and reference transistor 210 are made as PMOS field-effect transistors. The transformation ratio 1:N and thereby the proportionality between the load current $I_{LD}$ and reference current Iref are therefore similar to the ratio of the channel width of output transistor 100 to the channel width of reference transistor 210.

To drive the load current $I_{LD}$, output transistor 100 is arranged in a load current path 180 together with load 190. Driver circuit 10 is preferably integrated monolithically on a semiconductor chip, but load 190 is typically off-chip. Load 190 is connected to driver circuit 10, thus to output transistor 100, via a load terminal 110, for example, in the form of a metal pin or a pad.

Reference transistor 210 is arranged in a reference current path 280 together with a current source 290, current source 290 providing the reference current Iref. In this case, independent of the digital signal applied at the digital data input BIN, a reference current Iref flows from a positive supply voltage V+ via the drain-source path of reference transistor 210 and via current source 290 to a supply voltage V−, which is negative relative to the positive supply voltage V+ and represents, for example, a ground.

Reference transistor 210 is part of a reference network 200 in which additional components 220, 230 are provided. As part of the reference network 200, a PMOS field-effect transistor 220 is provided whose gate G220 in the exemplary embodiment of FIG. 1 is connected directly with reference current path 280 and with the drain terminal of reference transistor 210 and with current source 290. Source terminal S220 of PMOS field-effect transistor 220 is connected to gate G210 of reference transistor 210. Drain terminal D220 of PMOS field-effect transistor 220 is connected to the negative supply voltage V−.

PMOS field-effect transistor 220 is wired therefore as a source follower and has a low output resistance. The advantage is achieved as a result that load variations at gate G210 of reference transistor 210 lead to a smaller variation in the potential at gate terminal G210 of reference transistor 210. For PMOS field-effect transistor 220, wired as a source follower, furthermore, a resistance device 230 is provided, which is connected to source S220 of PMOS field-effect transistor 220 and the positive supply voltage V+. Due to this wiring, a reference voltage Uref adjustable by means of the reference current Iref drops across resistance device 230. The load current $I_{LD}$ is thereby also dependent on this reference voltage Uref.

Switching device 300 in the exemplary embodiment of FIG. 1 has a switching transistor 310 with a gate terminal G310, a drain terminal D310, and a source terminal S310. Switching transistor 310 in the exemplary embodiment of FIG. 1 is formed as a PMOS field-effect transistor. Control terminal G310 of switching transistor 310 is connected to a signal-shaping device 330, which outputs the signal supplied at gate G310, particularly the pulse shape. The control signal for control input G310 of switching transistor 310 can be controlled by means of signal shaping device 330 for the different requirements of different lasers and their use in different drives.

Furthermore, switching device 300 has a component 320, which is connected to control input G100 of output transistor 100 and to the supply voltage V+. This component 320 is, for example, a resistor which can also be called a pull-up resistor. Alternatively, component 320 is a controllable component such as, for example, a transistor.

In the turned-off state, switching transistor 330 is open. In this state, a reference voltage Vref is built up depending on reference current Iref. Reference network 200 forms a control loop with transistors 220 and 210, whose amplification (in the absence of a damping network 400) of the open loop is determined substantially by the internal resistance of reference current source 290. Switching on of output transistor 100 via switching transistor 310 causes the control loop to experience a great interference, which leads to a transient. The transient as a rule leads to an—undesirable—great overshoot in the output current/load current $I_{LD}$ and reference current Iref with a subsequent decline (damped oscillation).

The transient behavior of control loops is established by the amplification response and phase response of the control loop. The so-called phase reserve must be at least 90° so that a transient occurs without overshoot. The transient behavior can thereby be influenced by changing the impedance of reference current source 290. Because in the exemplary embodiment of FIG. 1 the amplification response and phase response of the control loop depend greatly on the value of the load current $I_{LD}$/reference current Iref and thereby on the value of the current pulse for the laser diode, the damping occurs surprisingly not via a fixedly defined damping element, such as, for example, a series connection of capacitor and resistor, but by a damping network 400, which is connected to reference current path 280 and another current source 490.

Preferably, the damping network is formed as a copy of the reference network. Damping network 400 is preferably formed the same way as reference network 200. The transistors are operated with the same current density in both networks 200 and 400. Because damping network 400 (in contrast to reference network 200) does not need to drive a large output transistor, its transient response is rapid or forms an equivalent damping resistance, which reduces the acting internal resistance of reference current source 290 by the parallel connection of damping network 400 to reference current source 290. The stability of driver circuit 10 is increased and the overshoot reduced by reduction of the loop gain of the control loop of reference network 200.

The result therefore is that the undesirable overshoot of load current $I_{LD}$, as caused by driver circuit 10 itself, is reduced or totally suppressed. In this case, the surprising effect becomes evident that in contrast to an arrangement of resistors and capacitors as passive damping elements, damping network 400 is more effective, because its behavior is influenced in a similar way by reference current Iref.

Preferably, but not necessarily, the components of reference network 200 and of damping network 400 have a geometric relationship. The components in this case are preferably formed in such a way that the current densities in reference network 200 and damping network are similar to one another. The geometric proportionality in this case is expressed by the factor X.

Driver circuit 10 of the exemplary embodiment of FIG. 1 can be described by the steady states "on" and "off," as well as the behavior during turning on and off. In the steady state "on," switching device 300 is low-impedance in that switching transistor 310 is turned on. The reference voltage Vref thereby is applied not only at gate G210 of reference transistor 210 but also at gate G100 of output transistor 100. Reference network 200 with reference transistor 210, together with output transistor 300, now forms a current mirror. Matching current densities are present in PMOS field-effect transistors 100 and 210.

Due to the geometric ratio of the channel widths between output transistor 100 and reference transistor 210, load current $I_{LD}$ is proportional to reference current Iref. In the "off" state, switching device 300 is high-impedance in that switching transistor 310 is turned off. Control input G100 of output transistor 100 is hereby supplied with the potential of the positive supply voltage V+, so that output transistor 100 blocks. Thereby, the load current $I_{LD}$ is also turned off, when the gate capacitance is discharged via resistor 320.

Figure 2:
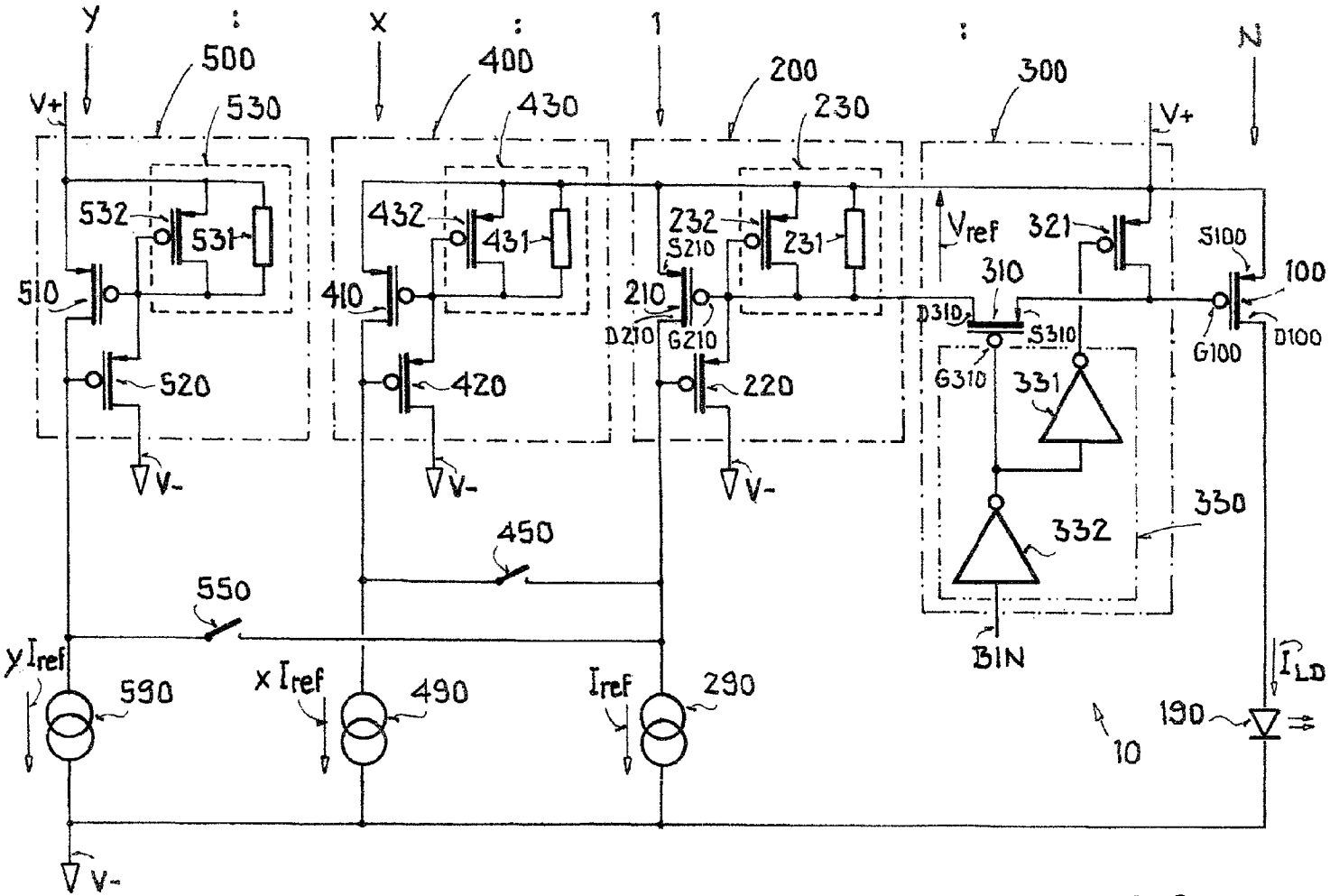
FIG. 2 shows a second exemplary embodiment of a driver circuit.

Another exemplary embodiment of a driver circuit 10 is shown in FIG. 2. Switching device 300 has a second switching transistor 321 in addition to first switching transistor 310. Signal-shaping device 330 has a first inverter 331 and a second inverter 332, which, for example, is made as a digital CMOS inverter and inverts the digital data applied at the digital data input BIN. Signal-shaping device 330 here has two outputs, whereby a first output is connected to first switching transistor 310 and a second output to second switching transistor 321.

In so doing, the control signal inverted to switching transistor 310 is provided at the control input of second switching transistor 321, so that the first switching transistor conducts when second switching transistor 321 blocks and so that second switching transistor 321 conducts when first switching transistor 310 blocks. Resistance device 230 which acts at the source of PMOS field-effect transistor 220 in the exemplary embodiment of FIG. 2 has a resistor 231 and a PMOS field-effect transistor 232 wired in particular as a MOS diode in a parallel connection.

A second damping network 500 is provided in addition to a first damping network 400. Each damping network 400, 500 is connected in each case to a current source 490 or 590. Furthermore, first damping network 400 is connected to the reference current path via a switch 450. Furthermore, second damping network 500 is also connected to the reference current path via a second switch 550. Switches 450 and 550 can be realized, for example, by a PMOS field-effect transistor. The exemplary embodiment of FIG. 2 by way of example here uses two damping networks 400 and 500 which can be switched on as needed via switches 450 and 550.

Of course, a greater number of damping networks may also be used. Preferably, both damping networks 400 and 500 have a connection of components, said connection which corresponds to reference network 200. To achieve preferably the same current densities in reference network 200 and in the two damping networks 400 and 500, the geometries of the components of networks 200, 400, and 500 are scaled to one another. To this end, first damping network 400 has a scaling factor of X and the second damping network a scaling factor of Y.

Both damping networks have transistor 410 or 510 corresponding to reference transistor 210. Both damping networks 400, 500 also have a PMOS field-effect transistor 420 or 520 corresponding to PMOS field-effect transistor 220. Resistance device 230 with a resistor 231 and PMOS field-effect transistor 232 finds an equivalent in the damping networks with the resistance devices 430 and 530, each of which have a resistor 431 and 531 and a PMOS field-effect transistor 432 and 532.

The current source 490 or 590 connected to the respective damping network 400 or 500 is adapted to the scaling X or Y, so that a current xIref of current source 490 and another current yIref of current source 590 are provided. These currents xIref and yIref for the same scaling factors X=Y can also be the same or for different scaling factors X≠Y accordingly differ from one another.

The turning-on process can be explained as follows with use of the exemplary embodiment of FIG. 2. Switching transistor 321 is first blocked by the logic signal at the digital data input BIN. Next, first switching transistor 310 is connected conductively and the gate-source voltage of output transistor 100 is thereby brought to the reference voltage Vref. Due to the geometric size of output transistor 100 and the associated greater gate capacitance than that of reference transistor 210, the charging current for gate G100 of output transistor 100 must be high for rapid turning on.

This charging current is also called a displacement current, because the gate capacitance of output transistor 100 is charged by it. The charging current leads to a decrease of the gate potential and thereby of the reference voltage Uref relative to the supply voltage V+. Thereby, the drain current through reference transistor 210 also becomes smaller, which in turn leads to a powering up of the PMOS field-effect transistor 220. Accordingly, transistors 210 and 220 form a control loop.

Due to the large gate capacitance of output transistor 100, the transient oscillation of this control circuit to a steady value is achieved only after an overshoot. The circuit of the exemplary embodiment of FIG. 2 therefore requires as additional measures, depending on the laser diode type, at least one of the damping networks 400 or 500, which dampen the regulating oscillation.

For turning off, first switching transistor 310 is blocked and second switching transistor 321 is turned on. In so doing, it is expedient first to block first switching transistor 310 and then to turn on second switching transistor 321. As a result, the subcircuit comprising reference network 200 and current source 290 to generate the reference voltage Vref is loaded as little as possible. To this end, in the exemplary embodiment of FIG. 2, first inverter 331 of signal-shaping device 330 delays the control signal for the second switching transistor relative to the control signal for first transistor 310.

In the exemplary embodiment of FIG. 2, the components of reference network 200 and the components of the respective damping network 400 or 500 have a geometric relationship. The geometric relationship of the components is such that the current densities in networks 200, 400, and 500 are the same. A proportionality factor of X=0.5 means, for example, that the channel width of transistor 410 is only 0.5 times the channel width of reference transistor 210. This applies accordingly also to resistor 431, which has half of the resistance value of resistor 231.

Figure 3:
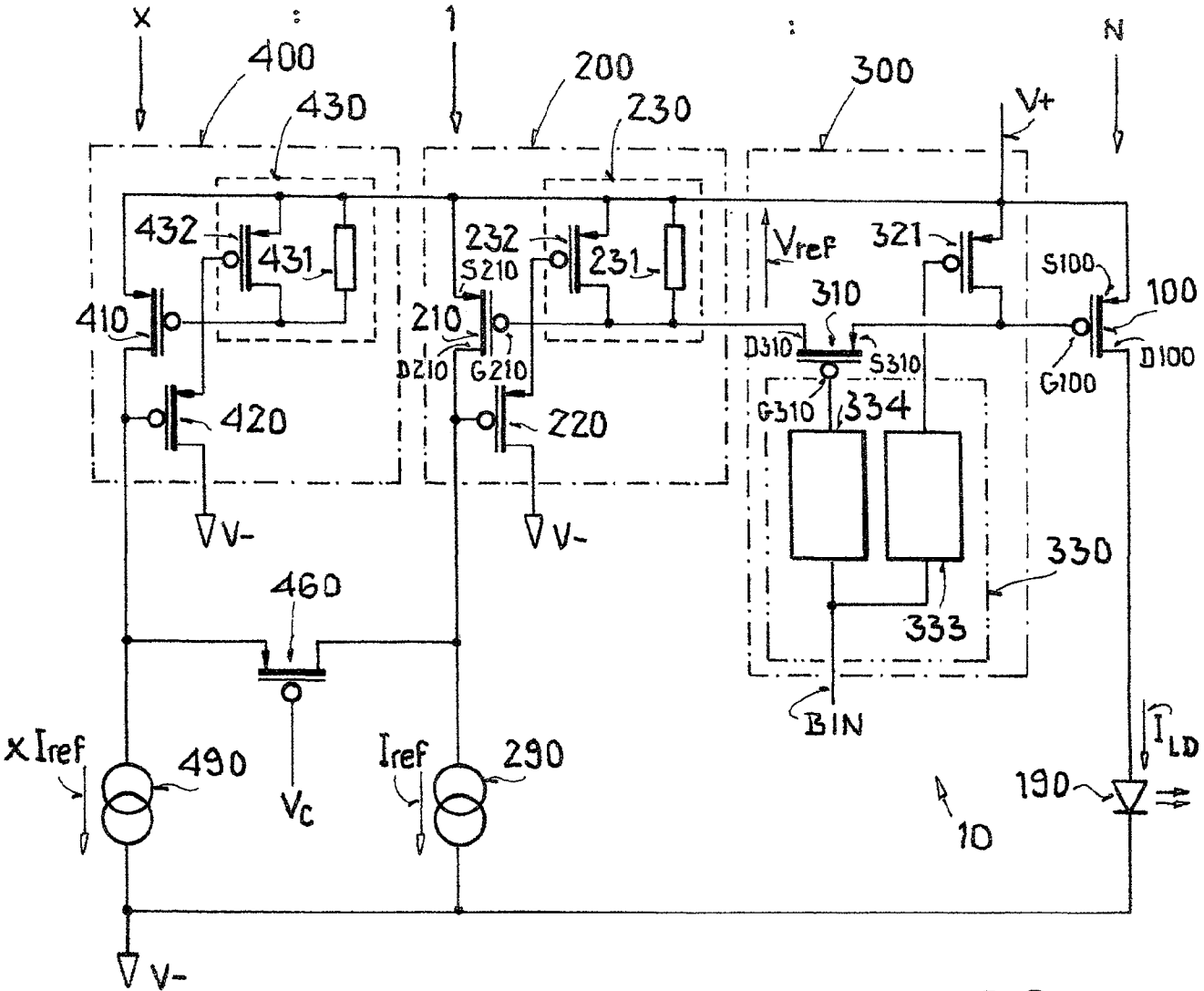
FIG. 3 shows a third exemplary embodiment of a driver circuit.

Another exemplary embodiment of driver circuit 10 is shown in FIG. 3. PMOS field-effect transistor 460 in this case is used as a controllable (active) resistor. To this end, an analog control voltage VC is applied at the PMOS field-effect transistor 460. It is possible to change the damping by damping network 400 by means of the analog control voltage VC, in that the degree of damping can be adjusted continuously by the variable resistance of the drain-source path of PMOS field-effect transistor 460.

A combination of exemplary embodiments of FIG. 2 and FIG. 3 is also conceivable, whereby both a continuous control element 460 and a discrete control element 450, 550 are used. The time sequence of the turning on and off of switching transistors 310 and 321 is influenced to a great extent also by the transient behavior of output current $I_{LD}$. In the exemplary embodiment of FIG. 3, pulse shapers 333 and 334 are therefore provided by means of which the control signals for switching transistor 310 and 321 can be optimized. Preferably, pulse shapers 333 and 334 are formed here in such a way that they provide signals complementary to one another at both outputs in the steady state.

The shown pulse shapers 333, 334 depending on the required application can generate fixed signal delays or signal delays different due to adjustment. For example, it can be desirable that the rising edge from 333 appears before the falling edge from 334 and the rising edge from 334 occurs before the falling edge from 333. Advantageously, pulse shapers 333 and 334 are formed to delay the rising and falling edges differently.

Figure 4:
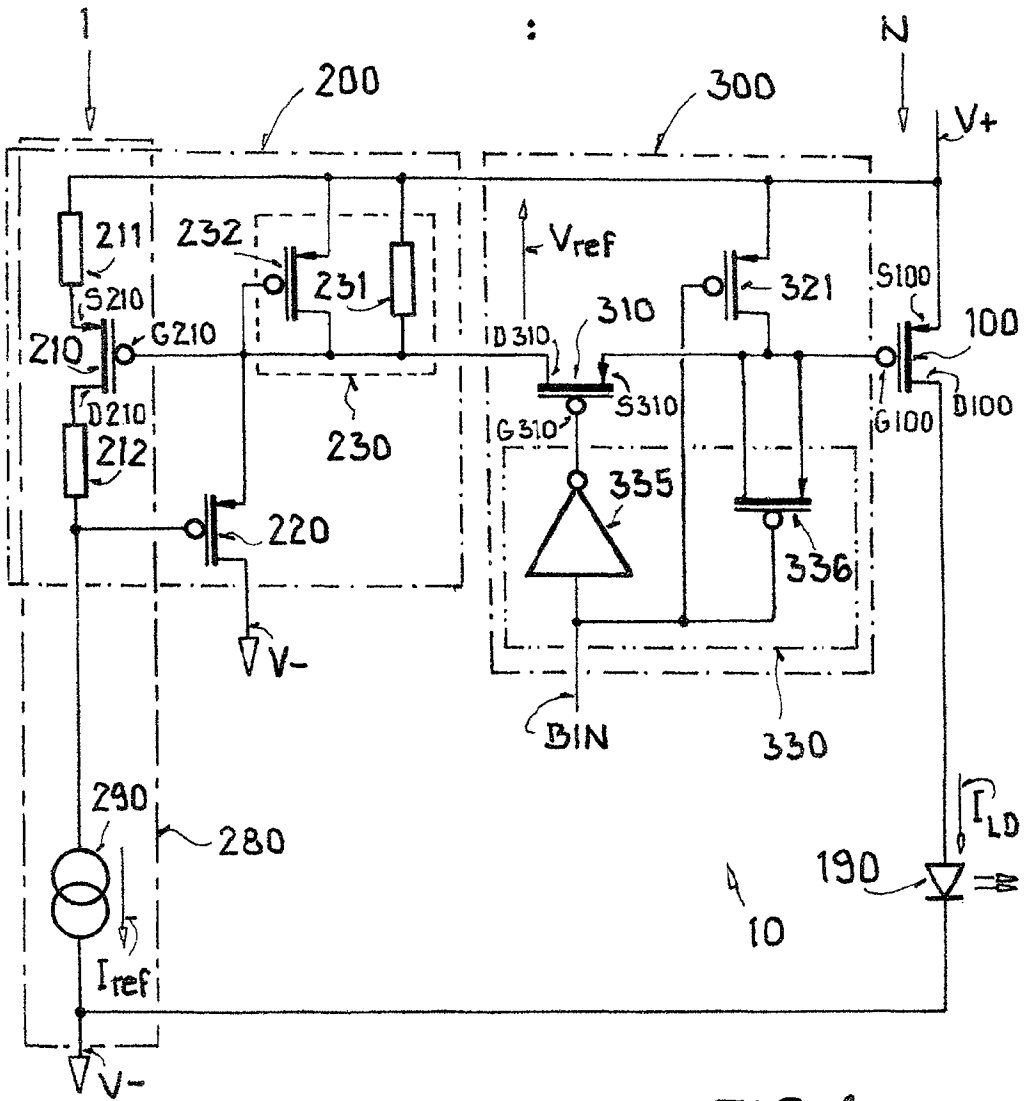
FIG. 4 shows a fourth exemplary embodiment of driver circuit.

Another exemplary embodiment of a driver circuit 10 is shown in FIG. 4. A first resistor 212 is arranged in the load current path 280, so that the reference current Iref flows across reference transistor 210, across first resistor 212, and across current source 290. It is considered here that the current transformation between the reference current Iref and the load current $I_{LD}$ is optimal only when the drain-source voltage of transistors 100 and 210 is as similar as possible. This can be achieved only approximately, however, due to the current-dependent voltage drop at the load element—laser diode 190 in the exemplary embodiment of FIG. 4.

The first resistor 212 in reference network 200 in the drain line of reference transistor 210 leads to a current-dependent decrease of the drain-source voltage of reference transistor 210. This can achieve that the drain-source voltage declines also for reference transistor 210 with an increasing current and thereby the current transformation 1 to N can be kept approximately constant.

A dependence of the transformation ratio N on the load current $I_{LD}$ is caused by the unavoidable voltage drops in connecting lines of the integrated circuit. Resistor 211 inserted in reference current path 280 in addition in the exemplary embodiment of FIG. 4 compensates for this effect in that the voltage drop produced there increases the gate-source voltage of output transistor 100 as a function of current and thereby counteracts the drop in the load current $I_{LD}$. Preferably, resistors corresponding to resistors 212 and 211 are also provided in damping networks 400, 500 and scaled with the corresponding scaling factor X or Y.

In FIG. 4, a MOS capacitor 336 is provided, which, for example, can be realized by a PMOS field-effect transistor with a connected source and drain. MOS capacitor 336 thereby forms a capacitive element, whose capacitance value is preferably the same as a capacitance value of first switching transistor 310. When switching transistor 310 is turned on, the electric load is transmitted via the capacitors of switching transistor 310 from control circuit 330 to the gate of output transistor 100. This results in particular at small load currents $I_{LD}$ in an additional excessive increase of the load current $I_{LD}$. This effect is compensated at least partially by MOS capacitor 336 controlled opposite-phased to the first switching transistor. With ideal dimensioning, the load transmitted by switching transistor 310 during the turning-on phase is reduced by MOS capacitor 336.

Figure 5:
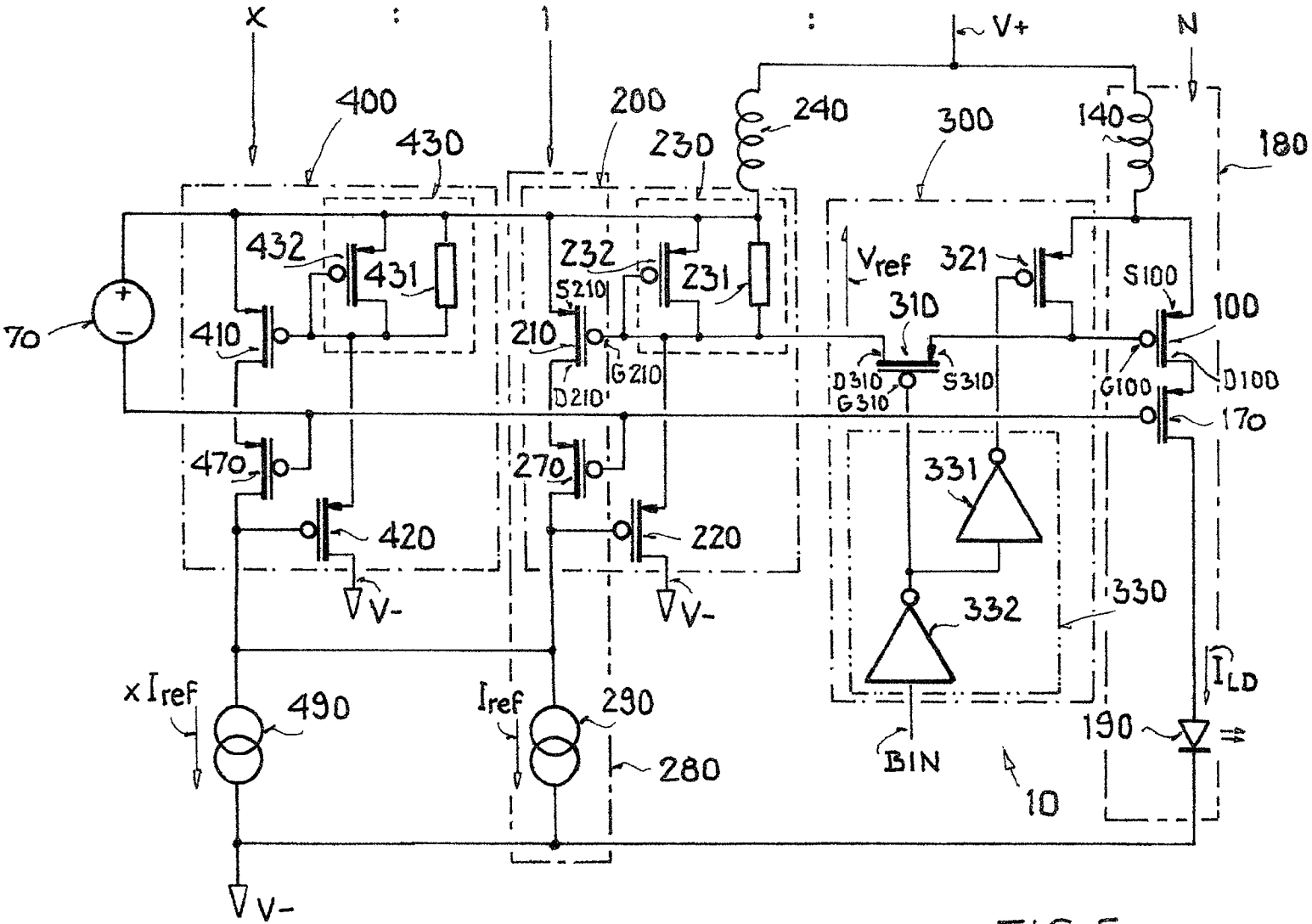
FIG. 5 shows a fifth exemplary embodiment of a driver circuit.

Another exemplary embodiment of a driver circuit 10 is shown in FIG. 5. In the control of high-impedance loads, for example, a blue laser diode, the use of a so-called cascode circuit is advantageous. The cascode circuit reduces the so-called Miller effect, which is caused by the drain-gate capacitance particularly of output transistor 100. The bandwidth of the circuit becomes greater due to the cascode circuit, so that more rapid switching processes can be achieved. In addition, the voltage dependence of the drain current through output transistor 100 is reduced.

To form the cascode circuit, in the exemplary embodiment of FIG. 5, PMOS field-effect transistors 170, 270, and 470 are provided, whose control inputs are connected mutually to a voltage source 70. Alternatively, other connections to provide a gate potential of the respective transistor 170, 270, 470 are also possible. For example, the gate potential can be derived from reference current Iref.

Transistors 170, 270, and 470 are operated in the gate circuit. PMOS field-effect transistor 170 is connected in a series circuit to output transistor 100. Both transistors 100, 170 are arranged in load current path 180. PMOS field-effect transistor 270 is connected in series to reference transistor 210, both transistors being arranged in reference current path 280. Preferably, transistors 170, 270, and 470 corresponding to transistors 100, 210, and 410 have a corresponding scaling X:1:N of the channel widths.

Advantageously, inductors 140 and 240 are generated by means of bond wires. The inductors of bond wires and their magnetic coupling influence the pulse shape of the load current $I_{LD}$. Here, output transistor 100 and reference transistor 210 are connected via separate bond wires 140 or 240 to the supply voltage V+. The voltage drop arising with rapid current pulses in output transistor 100 across bond wire inductor 140 leads to a damping of the overshoot and ringing. The method can be used in addition to a damping by damping network 400 or 500. The surprising effect that the overshoot caused by driver circuit 10 itself and the overshoot caused by the parasitic resonant circuit of lines can be compensated separately can be achieved by the combination of both damping options by means of damping networks 400 and 500 and the damping elements by inductors 140 and 240. The degree of damping can be varied over a broad range in this way.

The invention is not limited in this case to the shown embodiment variants in FIGS. 1 to 5. For example, it is possible to provide another damping network 500 and switches 450 and 550 also in the exemplary embodiments of FIG. 1, 3, 4, or 5. It is possible furthermore to provide the active resistor 460 and/or the pulse-shaping stage 333 or 334 in the exemplary embodiments of FIG. 1, 2, 4, or 5. It is possible furthermore to provide at least one of resistors 211 or 212 in the exemplary embodiments of FIG. 1, 2, 3, or 5. It is also possible to provide capacitive element 336 in one of the exemplary embodiments 1, 2, 3, or 5. It is likewise possible to provide the cascode arrangement of FIG. 5 with transistors 120, 270, and 470 in one of the exemplary embodiments in FIGS. 1 to 4. Inductors 140 and 240 can also be provided in one of the exemplary embodiments in regard to FIG. 1 to FIG. 4. Instead of PMOS field-effect transistors shown in FIGS. 1 to 5, alternatively or in combination complementary circuits or circuit parts with NMOS field-effect transistor can be used or connected.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A driver circuit comprising:

at least one output transistor;

a reference network having at least one reference transistor;

a switching device configured to be connectable to the control input of the output transistor and to the control input of the reference transistor to form a switchable current mirror;

a current source for providing a reference current for a reference current path, the current source and the reference transistor configured to be arranged in the reference current path;

a load terminal, the load terminal and the output transistor configured to be arranged in a load current path; and at least one damping network that is configured to be connected to or connectable to the reference current path;

wherein a connection of components of the at least one damping network and a connection of components of the reference network are substantially the same; and wherein at least one additional current source is connected to the damping network.

2. The driver circuit according to claim 1, wherein the components of the at least one damping network and of the reference network are formed geometrically in such a way that the respective current densities in the damping network and in the reference network are substantially the same.

3. The driver circuit to claim 1, further comprising a control element, configured to be connected to the damping network and the reference network to set damping by the at least one damping network.

4. The driver circuit according to claim 1, wherein the reference network has a first transistor that is connected as a source follower or emitter follower and whose control input is connected to the reference current path and whose source or emitter is connected to the control input of the reference transistor.

5. The driver circuit according to claim 4, wherein the control input of the first transistor of the reference network is connected to the current source.

6. The driver circuit according to claim 1, wherein the switching device has a first switching transistor, connected to the control input of the output transistor and to the control input of the reference transistor.

7. The driver circuit according to claim 6, wherein the switching device has a second switching transistor, connected to the control input of the output transistor and to a supply voltage.

8. The driver circuit according to claim 7, further comprising a signal-shaping device for shaping one or more of a first control signal and a second control signal for the first switching transistor or the second switching transistor, wherein the signal-shaping device is connected to the control input of one or more of the first switching transistor and to the control input of the second switching transistor.

9. The driver circuit according to claim 4, wherein the reference network has a first resistance element, arranged in the reference current path and connected to the reference transistor and to the control input of the first transistor.

10. The driver circuit according to claim 1, wherein the reference network has a second resistance element, arranged in the reference current path and connected to the reference transistor and to a supply voltage.

11. The driver circuit according to claim 1, wherein the switching device has a capacitive element, which is connected to the control input of the output transistor and in order to compensate for the displacement current is supplied by the first switching transistor with a signal inverted relative to the control signal of the first switching transistor.

12. The driver circuit according to claim 1, wherein, in the reference current path, another transistor is arranged, which is connected in series to the reference transistor to form a cascode circuit, wherein in the load current path another output transistor is arranged, which is connected in series to the output transistor to form an output cascode circuit, and wherein the control inputs of the additional transistors are connected to a voltage source so that the additional transistors are operated in the gate circuit or base circuit.

13. A method comprising:

setting a damping for a predefined signal shape of a load current to be driven; and connecting a reference current path of a switchable current mirror by at least one connecting element to at least one damping network for facilitating the predefined signal shape of the load current to be driven;

wherein the reference current path has a current source; and wherein at least one additional current source is connected to the damping network.

14. The method of claim 13, wherein:

the reference current path is part of a reference network having at least one reference transistor; and components of the at least one damping network and of the reference network are formed geometrically in such a way that the respective current densities in the damping network and in the reference network are substantially the same.

15. The method of claim 13, wherein the reference network has a first transistor that is connected as a source follower or emitter follower and whose control input is connected to the reference current path and whose source or emitter is connected to a control input of the reference transistor.

16. The method of claim 15, wherein the control input of the first transistor of the reference network is connected to the current source of the reference network.

17. A driver circuit comprising:

at least one output transistor;

a reference network having at least one reference transistor;

a switching device configured to be connectable to the control input of the output transistor and to the control input of the reference transistor to form a switchable current mirror;

a current source for providing a reference current for a reference current path, the current source and the reference transistor are configured to be arranged in the reference current path;

a load terminal, the load terminal and the output transistor are configured to be arranged in a load current path; and at least one damping network that is configured to be connected to or connectable to the reference current path;

wherein a connection of components of the at least one damping network and a connection of components of the reference network are substantially the same; and wherein the switching device has a capacitive element, which is connected to the control input of the output transistor and in order to compensate for the displacement current is supplied by the first switching transistor with a signal inverted relative to the control signal of the first switching transistor.

18. The system according to claim 17, wherein the components of the at least one damping network and of the reference network are formed geometrically in such a way that the respective current densities in the damping network and in the reference network are substantially the same.

19. The system according to claim 17, further comprising a control element, which to set damping by the at least one damping network is configured to be connected to the damping network and the reference network.

20. The system of claim 17, wherein the reference network has a first transistor that is connected as a source follower or emitter follower and whose control input is connected to the reference current path and whose source or emitter is connected to the control input of the reference transistor.

* * * * *